United States Patent [19]

Mowforth et al.

[11] Patent Number: 5,017,469

[45] Date of Patent: May 21, 1991

[54] TWINNED EMULSIONS MADE FROM SILVER IODIDE SEED CRYSTALS HAVING AN ASPECT RATIO OF AT LEAST 2:1

[75] Inventors: Clive W. Mowforth, Kingshill; James F. Bullock, Macclesfield; Trevor J. Maternaghan, Knutsford, all of United Kingdom

[73] Assignee: Ilford Limited, Knutsford, United Kingdom

[21] Appl. No.: 402,037

[22] Filed: Sep. 1, 1989

[30] Foreign Application Priority Data

Sep. 13, 1988 [GB] United Kingdom ..... 8821427

[51] Int. Cl.[5] ..... G03C 1/02

[52] U.S. Cl. ..... 430/569; 430/567

[58] Field of Search ..... 430/567, 569

[56] References Cited

U.S. PATENT DOCUMENTS

| | | | |
|---|---|---|---|
| 4,150,994 | 4/1979 | Maternaghan | 430/567 |
| 4,184,877 | 1/1980 | Maternaghan | 430/567 |
| 4,184,878 | 1/1980 | Maternaghan | 430/567 |
| 4,414,310 | 11/1983 | Daubendiek et al. | 430/567 |
| 4,490,458 | 12/1984 | House | 430/503 |

*Primary Examiner*—Charles L. Bowers, Jr.

*Assistant Examiner*—Thomas R. Neville

*Attorney, Agent, or Firm*—Darby & Darby

[57] ABSTRACT

There is described a method of preparing a silver halide emulsion wherein the silver halide crystals are of the twinned type which comprises the steps of (a) forming or providing in a colloid dispersing medium silver halide crystals containing at least 90 mole % iodide, at least 90% of which are of the hexagonal lattice structure with a mean thickness of less than 0.6 microns and a mean aspect ratio of greater than 2:1 (b) mixing in the dispersing medium containing the said silver halide crystals an aqueous solution of a silver salt and an aqueous solution of an alkali metal of ammonium bromide or chloride (or mixtures thereof) so forming twinned silver halide crystals containing iodide and the halide being added, optionally (c) adding a silver halide solvent to this dispersing medium and so causing the growth of the twinned crystals by Ostwald ripening and optionally (d) then causing the twinned crystals to increase in size by adding to the colloidal dispersion further silver salt solution and a further alkali metal or ammonium halide and then finally optionally (e) removing the water-soluble salts formed and chemically and spectrally sensitizing the emulsion.

18 Claims, 4 Drawing Sheets

TWINNED EMULSIONS MADE FROM SILVER IODIDE SEED CRYSTALS HAVING AN ASPECT RATIO OF AT LEAST 2:1

FIELD OF THE INVENTION

This invention relates to the production of silver halide emulsions and to photographic materials which comprise these emulsions.

BACKGROUND OF THE INVENTION

In British Patent Specification 1520976 there is described a method of preparing silver halide emulsions wherein the silver halide crystals are of the twinned type. This method involves the formation of silver iodide seed crystals. A soluble silver salt and another halide are added to the silver iodide seed crystals. In British patent specification 1570581 it is shown that the silver iodide seed crystals formed are of the truncated bipyramidal hexagonal lattice habit. When soluble silver and other halide salts are added to the dispersion of the silver iodide seed crystals the silver iodide crystals act as sites for the epitaxial growth of the twinned silver halide crystals. Similar growth of twinned silver halide crystals is shown in British Patent Specification 1596602.

In the process as described in BP 1570581 and in BP 1596602 crystals of high iodide content are first formed. Silver halide crystals which have a high iodide content that is to say from 90 to 100 mole % iodide are predominantly of hexagonal lattice structure. Techniques for the preparation of silver iodide crystals predominantly of hexagonal lattice structure are well-known, and are for example described by B L Byerley and Hirsch, *J. Phot. Sci.*, Volume 18, p 53 (1970). Such crystals have the shape of hexagonal pyramids or bipyramids. The basal faces of these pyramids comprise the lattice planes (0001). Silver iodide crystals of the hexagonal lattice structure are shown in FIG. 2 of British Pat. No. 1570581.

The disclosures of all documents referred to in this specification are incorporated by reference in their entirety.

In the process in step (b) as set out in No. 1570581 aqueous solutions of a silver salt and an alkali metal or ammonium bromide or chloride (or mixtures thereof) are added to the dispersion medium containing the silver iodide crystals which are predominantly of the hexagonal lattice structure, so that silver iodobromide (or iodochloride or iodochlorobromide) is precipitated. The mixed halide crystals precipitated are of the face centered cubic structure. These crystals incorporate silver iodide from the dissolving seed crystals up to a maximum of approximately 40 mole % of the total halide at a temperature of approximately 65° C. However, during this step the first-formed silver iodide crystals dissolve and the silver iodide is incorporated into the growing face-centered cubic lattice crystals. Electron micrographs have revealed that in step (b), whilst no overall circumferential growth of the silver iodide crystals occurs, the face-centered cubic lattice type crystals of the halide being added in step (b) form and grow epitaxially on the basal faces of the silver iodide crystals formed in step (a). Epitaxial growth is possible between (0001) AgI faces and (111) AgBr or AgCl faces because both are hexagonally close-packed, homoionic lattice planes. It has been observed by electron microscopy that at least about 90% of the growing epitaxial crystals are twinned (recognized by the parallel striations characteristic of several twin planes intersecting the surface) while attached to the parent silver iodide crystal. It is believed that this twinning is encouraged by the continuous supply of iodide ions to the growing (face-centered cubic) phase, either by bulk diffusion through the dispersing medium or by anionic diffusion through the crystal junction.

In general, one twinned face-centered cubic mixed halide crystal is formed at the single basal face of a hexagonal pyramidal silver iodide crystal, and two twinned mixed halide crystals are formed at the two basal faces of each hexagonal bipyramidal silver iodide crystal. FIG. 3 of No. 1596602 shows one of No. 1596602 hexagonal pyramidal silver iodide crystals (3a) and one hexagonal bipyramidal crystal (3b). As precipitation of the mixed silver halide is continued and the total iodide proportion of the silver halide suspended in the dispersion medium decreases to 30–40 mole % iodide, the dissolution of the originally formed silver iodide crystals becomes predominant and the 'dumb-bell'-shaped crystals of FIG. 4 of No 1596602 are observed. FIG. 4 of this patent, shows one twinned face-centered cubic crystal formed on a hexagonal pyramidal silver iodide crystal (4a) and one twinned face-centered cubic crystal formed at each basal face of a hexagonal bipyramidal silver iodide crystal (4b). As step (b) proceeds the twinned face-centered-cubic mixed halide crystals increase in size and the iodide crystals decrease in size. This stage is shown in FIG. 5 of No 1596602. Eventually the silver iodide linkage between the two twinned crystals (5b) is broken and the two twinned crystals are released. The residue of the silver iodide remains initially on the twinned face-centered-cubic crystals but eventually dissolves away and is incorporated in the growth crystals.

FIG. 6 of No. 1596602 is an electron micrograph showing the dumb-bell crystals of FIG. 4*b* in the process of recrystallization.

In the process described in No. 1596602 the supply of iodide ions in step (b) hereinafter called the recrystallization step is provided by further dissolution of the silver iodide crystals to maintain the equilibrium concentration given by the relationship:

$$[Ag+][I-]=k$$

where [Ag+], [I−] are the activities (in dilute solution the concentrations) of silver and iodide ions, and k is a constant (k is the well-known solubility product).

As hereinbefore stated, the incorporation of iodide in the growing crystals in step (b) encourages the formation of octahedral faces, and in particular, the formation of stacking faults known as twin planes. It is known that the formation of twin planes is not possible when the external faces of the crystals are the cubic (100) lattice planes (Berry and Skillman, Photographic Science and Engineering 6, page 159 (1962)), but can occur only when the external faces comprise at least partially the octahedral (111) lattice planes. Thus the incorporation of iodide in the recrystallization step (b) has the effect of encouraging twin formation, even under conditions where, with crystals containing no iodide, cubic external faces would normally be displayed.

In step (b) as iodide ions are removed from the solution phase by precipitation, they are rapidly replaced by the dissolution of further silver iodide crystals, so that depending on the addition rates of the silver and halide solutions the silver iodide crystals are completely dissolved by the end of the precipitation or recrystallization step (b).

SUMMARY OF THE INVENTION

Figure 1:
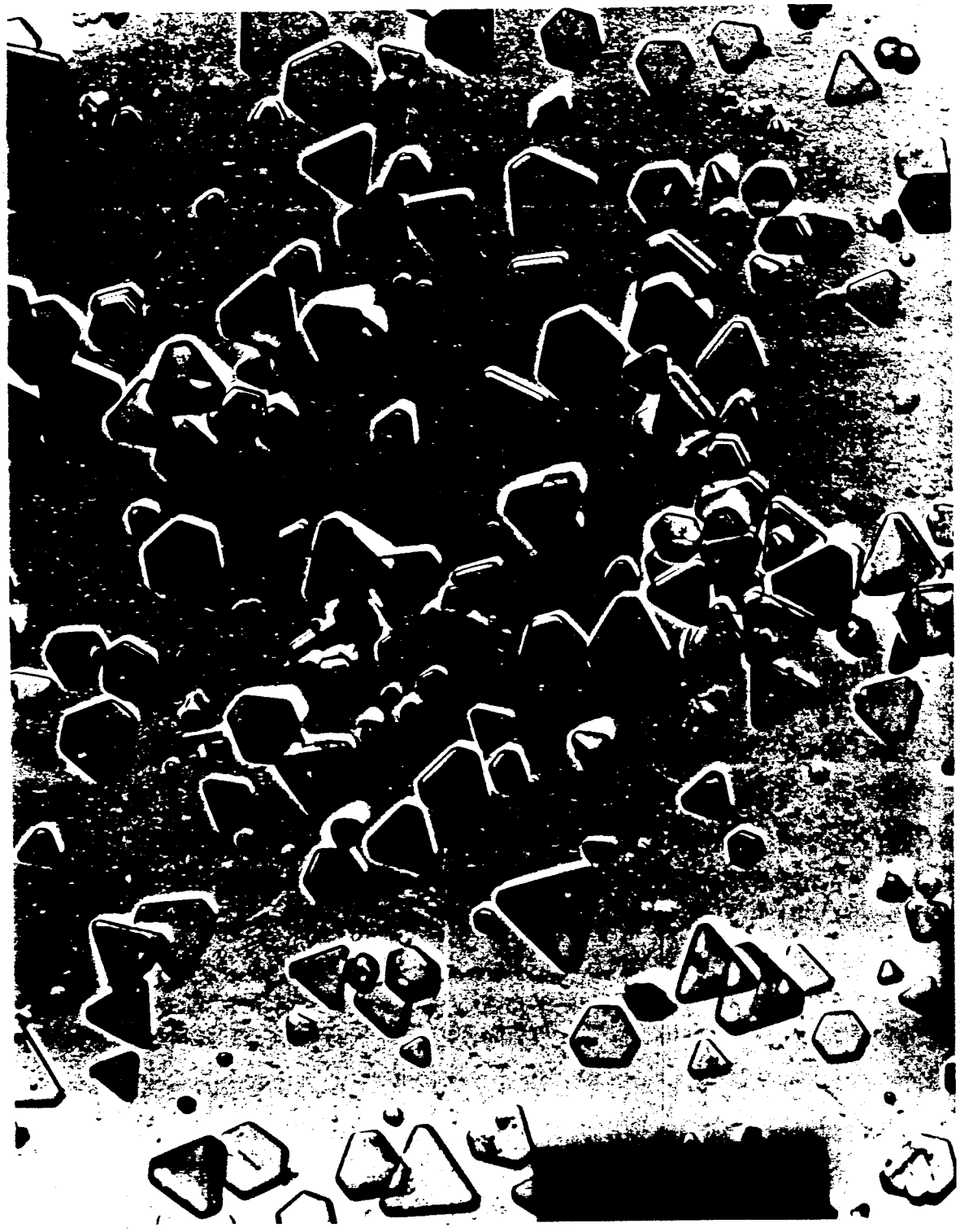
FIG. 1 is a electron micrograph (magnification 12800×) of tabular silver iodide crystals produced according to step (a) of Example 1.

It has been shown that in the preparation of silver iodide seed crystals described in British Pats No. 1570581 and No. 1596602 most of the seed crystals are of the truncated bipyramidal type with an aspect ratio of predominantly (i.e. at least about 80% of the crystals have an aspect ratio of) 1:1. However, we have found according to the present invention that twinned silver halide emulsions of greater aspect ratio may be prepared if the silver iodide seed crystals formed in step (a) are themselves of a tabular habit i.e. the ratio of the diameter of the crystals to their height is greater than 2:1.

DESCRIPTION OF THIS INVENTION

Therefore according to the present invention there is provided a method of preparing a silver halide emulsion wherein the silver halide crystals are of the twinned type which comprises the steps of (a) providing in a colloid dispersing medium tabular silver halide crystals containing at least 90 mole % iodide, at least about 90% of which are of the hexagonal lattice structure with a mean thickness of less than about 0.6 microns and a mean aspect ratio of greater than 2:1, (b) mixing in the dispersing medium containing the said silver halide crystals an aqueous solution of a silver salt and an aqueous solution of an alkali metal or ammonium bromide or chloride (or mixtures thereof) so forming twinned silver halide crystals containing iodide and the halides being added, said twin crystals having an aspect ratio greater than 1:1.

The method of the present invention may also comprise optional step (c): adding a silver halide solvent or complexing agent to the dispersing medium and so causing the growth of the twinned crystals by Ostwald ripening and optional step (d): then causing the twinned crystals to increase in size by adding to the colloidal dispersion further silver salt solution and further alkali metal or ammonium halide and optional step (e): removing the water-soluble salts formed and spectrally and/or chemically sensitizing the emulsion. Each of the optional steps may be performed or omitted independently of whether other optional steps have been performed or omitted.

DETAILED DESCRIPTION OF THE INVENTION

All patents and other documents cited herein are incorporated by reference in their entirety.

Tabular grains are herein defined as those having two substantially parallel crystal faces, each of which is substantially larger in area than the other crystal face of the grain. The thickness is the crystal height measured perpendicular to the major faces. The aspect ratio is the ratio of crystal diameter to crystal thickness, the diameter being that of a circle of equivalent area to the projected grain area (measured parallel to the major faces). "Substantially larger" means that each of the major faces have an area at least twice that of each of the lateral faces.

By Ostwald ripening is meant the dissolution of the smaller more soluble crystals.

The preparation of small (i.e. at most about 0.6 micron thick) tabular silver iodide crystals is described in U.S. Pat. No. 4,490,458 and in various references therein, such as Ozaki and Hachisu, *Science of Light*, 19:59–71, 1970; Zharkov et al, Zh. Nauch. Prikl. Fot. Kine, March–April 1957, 2:102–105; Daubendiek, Papers from the 1978 International Congress of Photographic Science, Rochester, N.Y., pp 140–143, 1978.

Most preferably, to obtain suitable silver iodide tabular seed crystals in step (a) the pI should be low, preferably about 3, where pI is $-\log_{10}[I^-]$.

Also preferably to obtain the tabular silver iodide seed crystals in step (a) the aqueous medium should be maintained between 70° to 95° C. and most preferably at about 90° C.

The size of the seed silver iodide crystals prepared in step (a) depends on the quantities of silver and iodide salts added during this step as well as on the agitation rate and temperature. At higher temperatures, and lower addition and agitation rates, larger size crystals tend to be formed. It is preferred that step (a) is terminated before the thickness of the seed crystals exceed 0.6 microns. The mean aspect ratio exceeds 2:1 and under some conditions (e.g., pBr of less than 2) aspect ratios of greater than 20:1 can be obtained.

In order to set a comparatively high initial iodide ion excess concentration in the colloid dispersing medium during step (a) sufficient alkali metal iodide is added to the dispersing medium to provide a pI of about 3.0 (which is about $10^{-3}$ M iodide) before the water soluble silver salt and alkali metal or ammonium iodide are added to the dispersing medium.

Preferably the water soluble silver salt and alkali metal or ammonium iodide used to form the tabular seed crystals are double-jetted into the dispersion medium which comprises some alkali metal iodide. Preferred silver salts are silver nitrate; preferred iodide salts are potassium iodide and sodium iodide.

In step (b), which can be called the recrystallization step, wherein twinned silver halide crystals are formed and the silver iodide tabular seed crystals are progressively dissolved causing the silver iodide to be incorporated into the growing mixed silver halide crystals preferably the temperature of the aqueous medium is from 35° to 90° C. and most preferably from 35° to 70° C. Preferred chloride or bromide salts for this step are: sodium chloride and sodium bromide.

During step (b) the pAg should be maintained between 5 and 11 and preferably between 6 and 10.

The concentration of the solutions used in step (b) is preferably between 1.0 and 5 M.

After step (b) the mole % iodide in the twinned silver halide crystals is preferably between about 30 and about 40. Step (b) is terminated when all the tabular silver iodide seed crystals have been consumed. (These seed crystals can be stored and steps (b), (c), and/or (d) may be carried out later.)

Step (c) the Ostwald ripening step is an optional step and is preferably employed when the conditions used produce a substantial proportion of untwinned silver halide crystals. In this step such untwinned crystals are dissolved.

Step (d) is the optional further growth step which serves to reduce the iodide mole % in the final silver halide crystals to within a preferred range of 0.5 to 20%. Most preferably the mole % iodide in the silver halide crystals after step (d) is from 5 to 20%.

The temperature, pAg and solution concentration ranges employed in step (d) are as in step (b). It may be preferred, however, to employ a different pAg in step (d) than in step (b), for example to promote a tabular habit, or to favor the twinned octahedral habit. A higher pAg promotes tabular habit.

When no step (c) is employed often step (d) follows on directly without a break from step (b).

Preferably in step (b) and in step (d) the soluble silver salt and the alkali metal or ammonium halide are added to the dispersion medium by the double jetting method. Most preferably the rate of addition of these solutions is controlled to provide a monodisperse silver halide emulsion i.e. renucleation or formation of a secondary population of untwinned crystals is avoided by the known methods.

Using the method of the present invention the resultant silver halide tabular emulsions produced have an increased covering power and a higher dyed speed than the emulsions produced by the methods described in British Patents No. 1520976, No. 1570581 and No. 1596602.

It is to be understood that steps (a) and (b) need not follow directly one after the other. For example the silver iodide colloid dispersion may be made beforehand and then stored. Further it is possible to commence step (c) before the completion of step (b). In such a case a silver halide solvent (such as ammonia, sodium thiocyanate or thioether) may be added with the fresh halide solution after only part of the bromide and/or chloride solution has been added to form the twinned silver halide crystals. If fairly small (e.g. 0.4 microns) silver halide crystals or ones of high iodide content are desired then step (d) may be omitted. However step (d) is of particular use in the production of monodisperse twinned silver halide emulsions as hereinafter described and therefore a method comprising step (d) is preferred.

Preferably in step (a) pure silver iodide crystals are formed but up to 10 mol % of other halides (chloride or bromide) may be present in the silver iodide crystals without disrupting their hexagonal lattice form. Thus it is to be understood that the term silver iodide crystals includes crystals containing up to 10 mol % of other halides. It is to be understood that a small fraction of the crystals formed (i.e. up to 10% by weight or number of the crystals) in step (a) may be predominantly non hexagonal, e.g. silver chloride or silver bromide and of the face-centered cubic lattice type, without marked effect on the process according to the invention.

The process of the present invention is particularly suitable for the production of twinned silver halide tabular emulsions of the monodisperse type. In the preferred method of achieving this the tabular silver iodide emulsion prepared in step (a) is itself of the monodisperse type. Such emulsions may be prepared by the mixing of aqueous solutions of a silver salt and an alkali metal or ammonium iodide in a stirred solution of a protective colloid, at a fixed temperature (constant within the range of about 70° to about 95° C.) and pAg (constant within the range of about 1 to about 4). Preparation methods are disclosed by House U.S. Pat. No 4,490,453. The final crystal size of the tabular silver iodide emulsion (where size is the diameter of a circle of an area equivalent to that of the large surface of the tabular crystals) is preferably in the range of about 0.01–5.0 micrometers. The halide solution is preferably potassium iodide, but up to approximately 10 mol % of chloride or bromide salt may be used. The hexagonal form of silver iodide is favored by growth on the iodide-rich side of the equivalence point, most preferably in the range pI 2–4.

The temperature of preparation of monodisperse tabular silver iodide seed crystals is preferred to be greater than 70° C., most preferably in the range of about 80° to about 90° C., to obtain high aspect ratios. As just stated the preferred diameter range of the tabular silver iodide crystals prepared in step (a) is within the range 0.05 to 5 micrometers. It has been found that the average size of the silver iodide crystals formed in step (a) influences the size of the twinned crystals formed in step (b). In general the larger the diameter of the silver iodide crystals produced in step (a) the larger the diameter of the twinned crystals formed in step (b).

The crystal size distribution of the final twinned emulsion depends also on the crystal size distribution of the silver iodide formed in step (a). Thus although it is preferred for high-contrast applications such as X-ray films that the silver iodide crystals in step (a) be essentially monodisperse, for low-contrast applications such as monochrome camera films it may be preferred for some purposes to prepare a relatively polydisperse twinned silver halide emulsion according to the present process by producing a relatively wide size distribution (e.g. with a size coefficiant variation greater than about 30%) of the silver iodide crystals prepared in step (a). Alternatively a wide size distribution may be produced by blending of monodisperse tabular silver iodide emulsions of different size before the commencement of step (b). Thus the control of size and size distribution of the twinned silver halide crystals produced in steps (b), (c) and (d) can be achieved by selection of the size and size distribution of the silver iodide crystals formed in step (a).

The tabular silver iodide emulsion prepared in step (a) may be characterized using shadowed electron micrographs. These reveal the habit of the individual crystals in the population and allow the thickness and equivalent circular diameter of each grain to be measured. In determining the aspect ratio of the emulsion, the aspect ratio of each grain is determined from the measured thickness and diameter, and it is the average of these determinations that is taken to represent the emulsion.

The proportion of hexagonal silver iodide in the tabular silver iodide emulsion prepared in step (a) (also known as the beta phase, or simply beta-AgI) may be measured using powder X-ray diffraction. The common secondary phase has a cubic lattice and is known as the gamma phase, or simply gamma-AgI. C. R. Berry (Phys Rev, 161, 848 (1967)) measured the relative intensity of the triplet of X-ray diffraction peaks occurring in the scattering angle range 22°-26° with copper $K_{alpha}1$ radiation to determine the relative proportions of the beta and gamma-phases in samples of silver iodide. This works well for samples in which the crystals are randomly oriented. With tabular silver iodide measurement of the relative proportions of the beta- and gamma-phases is difficult to achieve. For this reason it is preferred to record diffraction patterns over the range 50°-69°, encompassing the (202), (203), (210), (211), (105) and (212) reflection from beta-AgI, and the (400) and (331) reflections from gamma-AgI. The presence of peaks at 56.6° and 62.2° indicates the presence of gamma-AgI. The relative proportions of the two phases may be determined by fitting a theoretical profile to the experimental data, which takes into account the structure factors of the individual reflections and instrumental aberrations. (As decribed, for example, by B. L. J. Byerley, H. Hirsch in *J.Phot.Sci.* 18:53, 1970.) From the quality of the match achieved between the raw and calculated profiles, it can be readily seen if non-random crystal orientation is a problem.

Preferably, the recrystallization step (b) in which the twinned crystals are nucleated is effected by the addition of aqueous solutions of silver nitrate and sodium bromide or chloride or mixtures thereof to a stirred dispersion of silver iodide tabular crystals in gelatin solution, at a fixed temperature and pAg. Other alkali metal or ammonium salts of bromide or chloride may be used. Preferably no additional iodide is added in the halide solution, but the possibility of adding small amounts is not excluded (i.e. up to 10 mol % of the halide added in this step may be iodide). It is preferred that the silver iodide content in the dispersing medium at the commencement of this recrystallization step should be in the range of about 0.05 to about 2.5 moles/-liter, and most preferably in the range of about 0.5 to about 2.0. The silver and halide solutions may be any concentration up to the solubility limit at the particular temperature used. The preferred range lies within the limits of about 0.05 to about 5 M, most preferably of about 0.5 to about 2 M. The solutions may be stored at room temperature immediately prior to addition to the precipitation vessel, or kept at an elevated temperature, preferably in the range 30°-70° C. The pAg during the recrystallization step (b) is preferred to be maintained constant within the range 5.0 to 11.0 and most preferably constant within the range 6.0 to 10.0. The fixed temperature may be set within a wide range e.g. 35° to 90° C. It is most advantageous to maintain the flow rate of the silver nitrate solution constant during this stage with the necessary adjustments being made to the addition rate of the halide solution. However, as previously stated, even with the omission of step (c) in which silver halide solvent is added, the rate of addition of aqueous solutions in step (b) must be so controlled that by the end of this step the silver halide crystals formed are predominantly (i.e. more than 50%) twinned.

It is a particular feature of the present invention that in order to prepare a crystal population of the highest uniformity in step (b) which may be used to prepare monodisperse emulsions, the addition rates of the silver halide solutions added in step (b) should be predetermined. This can be accomplished by routine experiment as is well-known in the art. See, e.g., Lewis, J. *J. Phot. Sci.* 27:24, 1979. The optimal flow rates in this respect depend on the nature of the halide, and increase with the number of silver iodide crystals in the aqueous dispersion medium, decreasing average crystal diameter of silver iodide crystals, the pAg in the range specified above, and the temperature. Thus, higher rates of addition are required in the preparation of silver iodochloride or silver iodochlorobromide emulsions than in their silver iodobromide equivalents. The optimum rates of addition are illustrated in Examples 1 and 2.

It is preferred in the recrystallization step (b) that the volumes of silver nitrate and alkali metal or ammonium halides added should be such that the silver iodide comprises from 30 to 40 mol % of the total silver halide at the end of this step. As an indication of the appropriate flow rate the rate should be adjusted until the dissolution of the silver iodide is substantially complete by the time at which a quantity of silver nitrate one to three times that equivalent to the silver iodide has been added. One means of following the dissolution of silver iodide in step (b) and hence deducing the optimal flow rate is X-ray diffraction. As beta-AgI has an hexagonal lattice, and silver iodobromide with <40 mol % AgI a cubic lattice, quite different diffraction patterns are displayed by the two phases. Using copper $K_{alpha}$, radiation, a scan between 70° and 74.5° in scattering angle covers the (300) and (213) reflections of beta-AgI, the (422) reflection from any gamma-AgI present, and the (420) reflection or reflections from phases of cubic silver iodobromide.

The changes in relative intensity of these reflections through the recrystallization step (b) can be followed and it can be seen that the prominent (213) reflection from beta-AgI disappears when the average iodide content of the emulsion drops to 30 mol %. Another means of judging when the dissolution of silver iodide is substantially complete is by taking electron micrographs at different times during the recrystallization, as the distinctive crystal habit of the silver iodide crystals allows them to be differentiated from silver halide crystals of the usual face-centered cubic lattice.

It is apparent from the previous discussion of the mechanism of the process according to the present invention that electron micrographs of emulsion samples extracted during experimental preparations in which the addition rate during step (b) is varied can be used to give another indication of the optimal flow rates. If an Ostwald ripening stage step (c) of the present invention is to be included it is preferable to employ a constant flow rate in step (b) and electron micrographs of the final, ripened emulsion at the end of step (c) can be used to select the optimal rate of addition during step (b) that would produce a population of twinned crystals of greatest uniformity and shape. The optimal flow rate during step (b) which is most appropriate for the conditions chosen for the ripening step (c) can thus be determined by routine experiment, e.g., as taught in British Patent Specification No. 1469480 and as hereinbefore described.

It is a particular feature of the present invention that if the Ostwald ripening stage, step (c) is omitted, that in step (b) the addition rate of the reagent solutions should be so controlled that the silver halide crystals formed in this step are predominantly of the twinned type and that no substantial formation of new untwinned crystals takes place.

Preferably the addition rates should be so chosen also that no Ostwald inter-ripening among the existing population of twinned crystals should occur. However, the addition rate should be fast enough to ensure even growth of this basal face of the seed crystals without causing renucleation of a second population of silver bromide or silver chloride-rich crystals. The experimental procedures for determining the optimal range of flow rates are described in British Patent Specification No. 1469480.

An excessively low addition rate in step (b) would lead to incomplete recrystallization of the silver iodide crystals formed in step (a) and excessive widening of the size distribution of the twinned crystals which are formed, due to Ostwald ripening or due to uneven nucleation across the surface of the seed crystals. An excessively high addition rate in step (b) would lead to a substantial renucleation of untwinned crystals which could be readily detected due to their characteristic regular cubic or octahedral shape. In this case, only part of the final crystals will have been formed under the direct influence of the silver iodide, leading to a wide distribution of iodide content, and the size distribution of the final emulsion will invariably be bimodal. Both effects would lead to a loss of photographic contrast in the final emulsion. In addition the emulsion would be difficult to sensitize efficiently.

In step (b) epitaxial growth of silver halide occurs on the basal planes of the tabular silver iodide crystals prepared in step (a), as already discussed. The conditions chosen during the initial stages of step (b), i.e. the nucleation stage, influence the extent of the epitaxial growth over the basal planes of the silver iodide crystals. Again, the addition should be fast enough to ensure even growth on the basal face of the seed crystal without causing renucleation of a second population of silver bromide-or silver chloride-rich crystals.

To achieve a narrow size distribution of the crystals in the final emulsion prepared according to this invention it is necessary to ensure that epitaxial growth occurs evenly over the basal planes. In this way the tabular silver iodide crystals act as templates for the growth of twinned crystals of higher aspect ratio. If growth sites are few, particularly if located on the edges and corners, the twinned crystals may grow independently of each other, resulting in a larger number of crystals with a larger size distribution at the end of step (b). Among the factors influencing the uniformity of growth sites on the silver iodide basal faces are silver iodide crystal size, emulsion concentration, temperature, agitation efficiency, pAg and rate of addition of silver nitrate and halide solutions. For example, faster rates of addition are needed for larger sizes silver iodide seed crystal basal faces.

During step (b) the silver iodide seed crystals gradually dissolve and the iodide is incorporated in the growing twinned crystals. Various factors have already been described which can influence the extent of the recrystallization. These factors also influence the composition (iodide content) of the cubic silver halide phase in the twinned crystals. In particular, temperature, pAg and solution addition rates have a strong influence. At one extreme when high temperatures (generally about 65° to about 70° C.), high pAg (about 8.5 to about 9.5) and low addition rates (for example, 0.01 moles of silver nitrate per minute per mole of silver iodide seed) are employed, thermodynamic equilibrium is approached and the proportion of iodide in the twinned crystals is close to the theoretical equilibrium saturation limit, e.g. 39 mol % at 70° C. Under other conditions the process is kinetically controlled and a lower proportion of iodide is incorporated in the solid solution phase of the twinned crystals prepared in step (b).

If step (c) is employed, in order that ripening occurs at a conveniently fast rate during step (c) it is necessary to add silver halide solvents such as an excess of halide salts or ammonia, or other silver halide complexing agents such as sodium thiocyanate. The relative concentration of solvents may affect the crystal habit observed after ripening. The effect of excess bromide and ammonia in Ostwald ripening on the habit of silver iodobromide crystal is described by Marcocki and Zaleski (*Phot. Sci. Eng.* 17:289 (1973)); the effect of a slight (e.g. about 0.1 M) excess of bromide is to favor the formation of the octahedral habit.

The Ostwald ripening in step (c) of the present invention is most preferably carried out in conditions favoring octahedral habit. The preferred silver halide solvent is ammonia, added to a final concentration in the range 0.1–1.5 M and the preferred temperature for the ripening is between 50°–70° C. The preferred pAg value for the ripening stage is in the range 7–10. Excessively high temperatures (generally over 70° C.) or halide or ammonia concentration (generally over 0.5 M) usually results in a widening of the final size distribution.

In order to increase the rate of addition of the aqueous solutions in step (b) whilst still ensuring that the crystals obtained at the end of step (b) are predominantly of the twinned type, it is advantageous to employ small proportions of alkali metal halides in steps (a) and (b) which have cation radii which are appreciably different from the commonly used sodium potassium or ammonium salts.

Thus the optimal rate of addition employed during step (b) can be raised by employing a small proportion (e.g. about 0.1 to about 1.0 mole percent based on the iodide salt) of an alkali metal halide with a cation radius smaller than that of silver, such as lithium, during the preparation of the silver iodide crystals in step (a), or by employing a small proportion (e.g. about 0.1 to about 1.0 mole percent based on the halide salt) of an alkali metal halide with a cation radius larger than that of silver, such as rubidium, during the recrystallization step (b). A table of cation sizes is given by R. A. Robinson and R. H. Stokes in "Electrolyte Solutions" page 461, 2nd ed, Butterworths (1959). It is believed that small amounts of these ions become occluded in the respective silver halide lattices during precipitation, and increase the rate of conversion of the hexagonal lattice type crystals formed in step (a). Other possible methods of increasing the rate of epitaxial growth (or dissolution rate of the silver iodide crystals) during step (b) are to carry out step (b) in the presence of a wetting agent such as a polyalkene oxide condensate (e.g. p-isooctyl phenoxy polyethylene oxide) or a silver iodide solvent (e.g. pyridine). The amount of polyalkene condensate may preferably be in the range of about 0.5 to about 0.7 g per mole of silver and that of silver iodide solvent may preferably be in the range of about 0.1 to about 0.3 per mole of silver). It is believed that polyalkene oxides can accelerate the conversion of silver iodide to silver iodobromide, or iodochloride by complexing iodide ions or displacing gelatin from the surface of crystals undergoing recrystallization, whereas incorporation of a proportion of a silver iodide solvent in the dispersion medium during step (b) can affect the rate of conversion by a direct increase of solubility.

A high concentration of ammonia encourages the formation of the cubic habit in silver iodobromide crystals, and for this reason it is preferred that the recrystallization step (b) for silver iodobromide emulsions should be carried out in a low concentration of ammonia (e.g. <0.5 M). Conversely for silver iodochloride or silver chloride crystals, a high concentration of ammonia encourages the formation of the octahedral habit (Berg et al. Die Grundlagen der Photographischen Prozesse mit Silberhalogeniden Band 2 p 640) and therefore in the preparation of twinned silver iodochloride emulsions according to the first mode the recrystallization step (b) and ripening step (c) should be carried out at an ammonia concentration within the preferred range of 0.5–1 M throughout. This is conveniently achieved by the addition of a concentrated ammonia solution to the alkali metal or ammonium chloride solution. However, twinned cubic silver iodochloride emulsions may be formed without the addition of ammonia in the pAg range of about 6.0 to about 8.0.

Similarly within the scope of the present invention twinned silver halide photographic emulsions of the intermediate tetradecahedral habit may be produced by selection of the appropriate solution conditions, for example, in the pAg region of about 6 to about 8 in the presence of 0.2 M ammonia.

The process of the present invention is particularly suitable for the production of twinned silver halide emulsions of the monodisperse type. In this aspect of the invention step (d) is included and during this step further silver and halide solutions are added by a double-jetting method and at a controlled pAg, i.e. between about 6 and about 10.

Preferably the additional halide added during this stage is such that the iodide content of the final crystals is about 5–15 mol % which is the amount of iodide which has been found to be most beneficial, yielding high-speed emulsions for negative working photographic material.

The halide solution added in step (d) can be any combination of alkali or ammonium salts of chloride, bromide or iodide. It is preferred that the iodide content is restricted to no more than 15 mol %, most preferably no more than 10 mol % The proportion of iodide in the halide stream can be varied with time: it can be decreased at a constant rate, to produce smoothly decreasing iodide levels towards the surface of the final emulsion crystal, or it can be changed by abrupt increments introduced under such conditions to favor the creation of a distinct interface between two phases of different iodide content. An example of an abrupt change of the halide stream is from 10 mole % iodide to 5 mole % iodide. The introduction of this internal iodide, i.e. in addition to that derived from the tabular silver iodide seed emulsion, can be used to prevent complete development of individual crystals, with a consequent improvement in image quality. See, K. Radcliffe, *J.Phot.-Sci* 24:198, 1976.

In step (d) in the process of the present invention it is preferred to maintain the pAg in the range 5.0 to 11.0 and most preferably in the range 6.0 to 10.0. The temperature may be set within a wide range, for example 35° to 90° C. It is a particular advantage of this invention that these values may be varied during step (d). For instance by controlling the temperature, pAg and reagent solution addition rates during the initial stages of this step, dissolution of the emulsion crystals produced in steps (b) or (c) can be largely prevented. If the crystals dissolve the variables should be adjusted in the following order: increasing the addition rate, decreasing pAg, increasing temperature.

This is useful in producing core/shell twinned emulsions. Twinned emulsions of high sensitivity can be produced by forming twinned crystals of high iodide content in step (b) of this intention, then adding silver nitrate and sodium bromide to this in step (d) producing a core/shell emulsion, where the iodide is relatively concentrated in the center of the emulsion grains.

The pAg can be varied during step (d) of this invention to modify the habit of the final twinned emulsion crystals. By selection of fixed pAgs in the range 6 to 9, (100) external faces are favored leading to cubic crystals. It is a particular feature of this invention that crystals displaying the cubic habit can be prepared with a low size distribution whilst containing high levels of iodide. To obtain the highest monodispersity it is preferred that the silver iodide seed emulsion prepared in step (a) of this invention is monodisperse, and that in step (b) epitaxial growth is effected over the whole of each basal face of each seed crystal. (The basal face is the large top or bottom face of a hexagonal lattice type silver iodide crystal.) By selection of appropriate pAg (e.g. 8–11 at 65° C.) (111) crystal faces are favored. The exact value chosen dictates the relative growth rates of the major faces and the edges. High values of pAg favor growth on the face around the perimeter of the crystal where the twin planes emerge and this leads to an increase in aspect ratio of the crystals. Low values of pAg lead to significant growth rates on the major faces parallel to the twin planes, leading to a thickening of the crystals and a lowering of the aspect ratio.

Moreover, the silver halide crystals of the photographic emulsion produced by the process of the present invention can be predominantly of the desirable tabular twinned type when the growth step (d) or the Ostwald ripening step (c) or growth step (d) of the second mode, is carried out in conditions favoring the octahedral habit and usually more than 50% by weight or number of the silver halide crystals present are of this type under these conditions.

In the preferred method a high, i.e. greater than 2:1, aspect ratio silver iodide seed emulsion is prepared in step (a) of this invention. In the recrystallization step (b) adoption of a high nucleation rate ensures large thin twin crystals are formed. Step (c) is omitted and perimeter growth in step (d) is promoted by adoption of high pAgs. By such a process tabular twinned emulsion of aspect ratios up to 20:1 can be produced. The preferred range is 3–20:1, most preferably 5–10:1. By adoption of the appropriate halide solutions and conditions set forth above high aspect ratio tabular twinned emulsions can be prepared with a high overall iodide level, the iodide being concentrated in the core of the emulsion grains.

The water soluble salts formed or the ripening agents added during the process of the present invention may be removed by any of the well-known methods. Such methods often involve flocculating the silver halide and colloid dispersing agent, removing this flocculate from the then aqueous medium washing it and redispersing it in water. One other common method is ultrafiltration, in which the emulsion is passed over a membrane under pressure.

The pore size of the membrane is such that the silver halide crystals and most of the colloid dispersing medium is retained, whilst water and solutes permeate through. Most of the well-known methods allow the emulsion to be concentrated as well as washed. This is important when weak reagent solutions are employed, particularly those with concentrations below 3 M.

It is preferred to wash and concentrate the final emulsion prepared by the process of this invention. Advantages may also result from washing and concentration during the process of this invention. In step (a), the preferred method of preparing the silver iodide seed crystals uses reagent solution of concentrations up to 1.5 M resulting in a very dilute emulsion. In step (b) uniform nucleation over the whole area of the basal planes of each tabular seed is facilitated by using concentrated emulsion high in silver content, preferably with a concentration greater than 1 mol Ag $dm^{-3}$. Hence a concentration step may be desirable after step (a) is completed. As already mentioned, core/shell emulsions may result from the process of this invention. Desalination may be effected after formation of the silver iodide seed, after completion of step (b), or after the step (d). Further advantages may result from washing and concentrating the emulsion at other stages in the process of this invention. It is specifically contemplated that water soluble salts be removed at any step of the process of this invention by, for instance, recirculating emulsion in the precipitation vessel through an ultrafiltration membrane.

Blending of emulsion components may take place at any stage in the preparation of the final emulsion according to the process of this invention. This may be done to adjust contrast and exposure latitude, as has already been mentioned. In the preferred method, the components are blended after step (e), that is after the components have been optimally chemically sensitized or after both chemical and spectral sensitization has taken place.

The silver halide crystals may be chemically sensitized at any stage of growth by any of the well known means, for example by use of sulphur or selenium compounds or salts of the noble metals such as gold, iridium, rhodium, osmium, palladium or platinum. For example, sodium tetrachloroaurate dihydrate, sodium thiosulphate and sodium chloropalladate. Chemical sensitization is optionally carried out in the presence of sulphur containing ripening agents, such as thioethers or thiocyanate compounds, for example, sodium thiocyanate. Often the fully grown crystals may be sensitized in this manner, so that the products of chemical sensitization are formed on or close to the surface of the crystals, so that such sensitized crystals would become developable in a surface developer after exposure to light. This can be accomplished by heating the emulsion to above 50° C. in the presence of a sensitizer.

Emulsions comprising such sensitized crystals would be suitable for negative film materials. However it is sometimes required for direct positive materials, that the products of chemical sensitization are produced in the interior of the crystal. Another of such products of chemical sensitization may be incorporated into the body of the crystals by heating the crystals at the required stage of growth (e.g. when about half the crystal volume has been deposited) with appropriate sensitizing compounds. These can include salts of non-metals, such as sulphur or selenium or metals such as gold, platinum, palladium, iridium, rhodium, thallium, osmium, copper, lead, cadmium, bismuth and the like, with sodium chlororhodite being preferred. It is also possible to effect internal reduction sensitization by treating the crystals with reducing agents for example thiourea dioxide, hydrazine, formaldehyde or tin compounds, such as stannous chloride. These compounds can either be added continuously during a part of the whole of the crystallization process, for example by incorporating them into the feedstock solutions; or alternatively the crystallization process can be halted, the part-grown crystals treated with the appropriate reagent, and growth recommenced.

Such internally modified crystals can be used in a variety of processes. For example, a direct-positive emulsion can be prepared using the following broadly-defined stages: (i) treating the crystal at an intermediate stage of growth in such a way as to produce centers which promote the deposition of photolytic silver (treatment with iridium or rhodium salts being particularly preferred), (ii) completion by the addition of the metal salt and heating of the growth process, (iii) fogging of the crystal surface either by exposure to actinic radiation or by chemical reduction (in the preferred process the crystal is fogged by a combination of a reducing agent and a compound of a metal more electropositive than silver, such as gold or palladium). Such an emulsion, after coating, imagewise exposure, and development with a surface developer will yield a direct positive image. The usual additives can be applied to the direct positive emulsion if desired; e.g. soluble halides to increase speed, sensitizing or desensitizing dyes to increase spectral range, electron trapping agents, blue speed increasing compounds and the like.

Internally modified crystals may also be prepared to provide emulsions with an enhanced ratio of internal to surface speed. Whilst a number of the previously-mentioned methods can be used, the preferred technique is to (i) precipitate a core emulsion, (ii) sensitize the surface of the core crystals using a sulphur compound and/or a gold compound as in the known art, and then (iii) grow a shell of silver halide onto the core emulsion by one of the known techniques such as Ostwald ripening in the presence of suitable ripening agents, double jet growth, or pAg cycling through the neutral point.

For certain purposes, such as direct positive imaging materials, other techniques can produce emulsions the internal/surface sensitivity relationship of which is comparable with that obtained from internal gold/sulphur sensitization. One example of such technique is doping with heavy metal ions (gold, iridium, rhodium, palladium, or lead); another in one of the halide conversion techniques, and halide layering techniques.

The speed of such internally sensitized emulsions may be increased by adding one or more of sensitizing reagents commonly used with negative emulsions such as sodium-p-toluene thiosulfinic acid. In particular, it is possible to sensitize spectrally these emulsions with dyes of the type commonly used with surface-sensitive negative emulsions, e.g. cyanine dyes. It is advantageous in this case to use high surface coverage of dye, such as would cause desensitization in a surface-sensitized emulsion of the same size, since the internal image is not subject to dye-induced desensitization. Thus, amounts of dye ranging between about 0.4 and about 1.0 g per mole of silver halide are preferred.

Internally sensitive emulsions can be developed using one of the techniques known in the art. These mainly involve a developer of standard type (such as metol/hydroquinone developing solution) with the addition of quantities of either free iodide, or a silver halide solvent such as an alkali thiosulfate. Optionally, the surface can be bleached with an oxidizing agent before development, to remove surface image (Sutherns, J Phot Sci 9. 217 (1961)).

If the shell silver halide layer is thin (of the order 15 lattice planes) it is possible to develop the crystal in a surface developer, such as metol/ascorbate developing solution. Such a technique produces an emulsion yielding a conventional surface image but again avoids the desensitization resulting from large dye additions to surface-sensitive emulsions.

By using a surface developer containing certain fogging (or nucleating) agents, such as certain substituted hydrazine compounds or certain quaternary ammonium salts, it is possible to produce a direct-positive image with the internally-sensitive emulsions described above. Suitable hydrazine compounds include sodium phenyl hydrazide and suitable ammonium salts include cetyl pyridinium bromide. It may also be advantageous in this case to introduce a small degree of surface sensitivity into the crystals. Internally-sensitive emulsions may be produced by interrupting the crystal growth at any stage during the steps (a)–(d) according to the present invention, and then adding such chemical sensitizing agents as those mentioned above. After such a chemical sensitization, crystal growth is resumed so that the sensitivity centers become "buried" inside each crystal. Such techniques are well known and are described for example in British Patent Specification 1027146.

The process of the present invention can be used to prepare direct positive emulsions, using otherwise conventional technology as described, for example, in BP 723,019, and in the paper by Vanassche et al. J Phot Sci 22, 121 (1974).

The silver halide emulsion as prepared by the process of the present invention is fogged using a combination of a reducing agent (thiourea dioxide, hydrazine, tin salts, and several others are known) and a compound of a metal more electropositive than silver (gold and/or palladium are preferred). An electron-trapping compound, preferably one which is also a spectral sensitizer for the direct positive process (such as phenosafranine), is added and the emulsion is coated. After exposure and development a surface image is revealed. It is also possible to incorporate into such emulsions one or more of the additives normally used with fogged direct positive emulsions, for example soluble halides, sensitizing dyes and blue-speed increasing compounds. It is also possible to protect the surface fog from atmospheric oxidation by covering it with a thin silver halide layer (in accordance, e.g. with the process disclosed in D. M. Sturmer and L. N. Blackburn, *Phot.Sci.Eng.* 19, 352 (1975)) so that it is still accessible to conventional surface developers. In direct positive systems of this type cubic crystals are generally preferred, because they give better speed and contrast.

It is to be understood that the twinned crystals formed at the end of step (b) are often very small crystals which are only of use as seed crystals. These crystals may be grown to usable size during step (d). However, as hereinbefore stated it is possible to have a prolonged step (b) so that at the end of step (b) usable crystals are produced. Nevertheless in the process of this invention step (b) may merge into step (d) without any interruption in the addition of the aqueous solutions occurring in the second step.

However in general the twinned crystals form at the end of step (b) in turn may be used as seed crystals, thus the silver iodide dissolved from the silver iodide crystals formed in step (a) will be present in the seed crystal and thus after the growth step (d) will be present in the core of the crystal unless further iodide is added during step (b). Similarly if noble metals are present in step (a) these will be included in the twinned seed crystals formed in step (b) but after the growth step (d) will be present in the final crystals as part of the core.

In order to alter the properties of the final silver halide crystals it is possible to alter the halides added during step (b) or to change completely the halides or halide ratios employed from step (b) to step (d). For example, if good image quality is desired, iodobromide may be jetted in, but if rapid development is required, chlorobromide may be jetted in. Thus it is possible to obtain layers of particular halide ratios in the final crystals by arranging for a particular halide or mixture of halides to be used at any stage in step (b) or in step (d) in the process of the present invention.

Where the emulsions prepared by the process of the present invention are to be used for direct positive materials or other applications where internally sensitive crystals are desired, it is advantageous that the halide precipitated during the first part or the whole recrystallization step (b) or ripening step (c) (if included) the halides in step (d) are added so that up to 15 mole % is precipitated in a "shell" surrounding the "core" twinned crystals formed in step (b), as discussed already, and that up to 10 mole % chloride is precipitated in the outermost shell of the crystals. The chloride is added as part of the halide stream in step (d).

Thus silver iodochlorobromide emulsions can be prepared according to the present invention with crystals containing "internal" iodide (in addition to that derived from the original silver iodide crystals) and "surface" chloride layers.

Such "core-shell" emulsions are well known and are also described in British Patent Specification 1027146.

The emulsions prepared by the process of the present invention may be spectrally sensitized by the addition of spectral sensitizers for example carbocyanine and merocyanine dyes to the emulsions. Suitable dyes are disclosed in James, The Theory of the Photographic Process, 4th Ed., MacMillan, Chapter 8.

The emulsions may contain any of the additives commonly used in photographic emulsions for example wetting agents, such as polyalkene oxides, stabilizing agents, such as tetraazaindenes, metal sequestering agents, growth or crystal habit modifying agents commonly used for silver halide such as adenine, and plasticizers such as glycerol to reduce the effects of mechanical stress.

Preferably the dispersing medium is gelatin or a mixture of gelatin and a water-soluble latex, for example a latex vinyl acrylate-containing polymer. Most preferably if such a latex is present in the final emulsion it is added after all crystal growth has occurred. However other water-soluble colloids for example casein, polyvinylpyrrolidone or polyvinyl alcohol or hydrophilic cellulose ethers and esters may be used alone or together with gelatin.

The silver halide emulsions prepared according to the process of the present invention exhibit an improvement in speed/granularity, particularly in the green and red region of the spectrum.

The silver halide emulsions prepared according to the present invention thus are of use in many types of photographic materials such as X-ray films, camera films; both black and white and color, paper products and their use could be extended to other materials for example direct positive materials.

Thus the invention includes silver halide emulsions prepared by the process of the present invention and coated photographic silver halide material containing at least one such emulsion.

The following examples will serve to illustrate the invention together with the attached drawings without limiting its scope.

EXAMPLE 1

Preparation of a Tabular Twinned Octahedral Silver Iodobromide Emulsion (Emulsion B) An Emulsion According to the Present Invention

Preparation of a Monodisperse

Tabular Silver Iodide Emulsion (Step a)

12000 g of 1.1% w/w aqueous solution of inert gelatin was stirred at 40° C. at 400 rpm in a stainless steel vessel. Tri-N-butyl orthophosphate was added as an antifoam and the pH was adjusted to 5.8. The temperature was raised to 90° C. and approximately 180 $cm^3$ of 3 M KI was added until pI 3 was attained, as measured using a silver ion electrode with a standard calomel electrode. Aqueous 1.5 M solutions of silver nitrate and potassium iodide were jetted into the stirred gelatin at a rate (for the silver nitrate) increasing from approximately 127 $cm^3$/min to 192 $cm^3$/min until a total of 4620 $cm^3$ of silver nitrate solution had been added over a period of 30 minutes. The pI was maintained at 3 by controlling the flow rate of the potassium iodide solution.

The final emulsion contained 6.9 moles of silver halide. The crystals of this emulsion are shown in FIG. 1. They had a mean diameter of 0.93 microns based on a measurement of projected area. The aspect ratio of at least 80% of the silver iodide crystals was at least 10:1.

The emulsion was then desalinated.

Recrystallization (Step b)

4076 g of the silver iodide emulsion grown in step (a) which contained 6 moles of silver iodide was stirred at 65° C. at 400 rpm in a stainless steel vessel. Tri-N-butyl orthophosphate was added as an antifoam. Aqueous solutions of silver nitrate (2.5 M) and sodium bromide (1.5 M) were jetted into the stirred silver iodide emulsion at rates (for the silver nitrate) increasing from 0.024 mol/min to 0.048 mol/min until 0.6 mol of silver nitrate had been added over a period of 19 minutes. 720 g of 25% w/w aqueous inert gelatin was added and further volumes of the silver nitrate and sodium bromide solutions were jetted in at a rate of 0.018 mol/min for the silver nitrate until 8.4 mol of silver nitrate had been added.

403 g of the above gelatin solution was added, and further volumes of the silver nitrate and sodium bromide solutions were jetted in at a rate of 0.036 mol/min until 5.0 moles of silver nitrate had been added.

The pAg of the emulsion was maintained throughout at approximately 7.65 by adjusting the bromide solution flow rate and the temperature was maintained at 65° C. They had a mean crystal diameter of 0.74 microns (based on a measurement of average volume). The yield was 20 moles of silver halide with an overall content of 30 mole % silver iodide.

Further Growth (Step d)

4791 g of the above mixed silver iodobromide emulsion which contained 2.78 moles of silver halide was stirred at 65° C. at 400 rpm in a stainless steel vessel. 0.2 $cm^3$ of tri-n-butyl orthophosphate was added as an antifoam. 148 g of 25% w/w aqueous inert gelatin was added. Aqueous solutions of silver nitrate (1.5 M) and sodium bromide (1.5 M) were jetted into the stirred silver iodobromide emulsion at rates (for the silver nitrate) increasing from 0.015 mol/min to 0.03 mol/min until a total of 1.85 mole of silver nitrate had been added over a period of 86 minutes.

296 g of the above gelatin was added and further volumes of the silver nitrate and sodium bromide solutions were jetted in at rates (for the silver nitrate) increasing from 0.06 mol/min to 0.09 mol/min until 3.69 mol of silver nitrate had been added over a period of 53 minutes.

The pAg of the emulsion was maintained throughout at 9.16 by adjusting the flow rate of the bromide solution and the temperature was maintained at 65° C.

Figure 2:
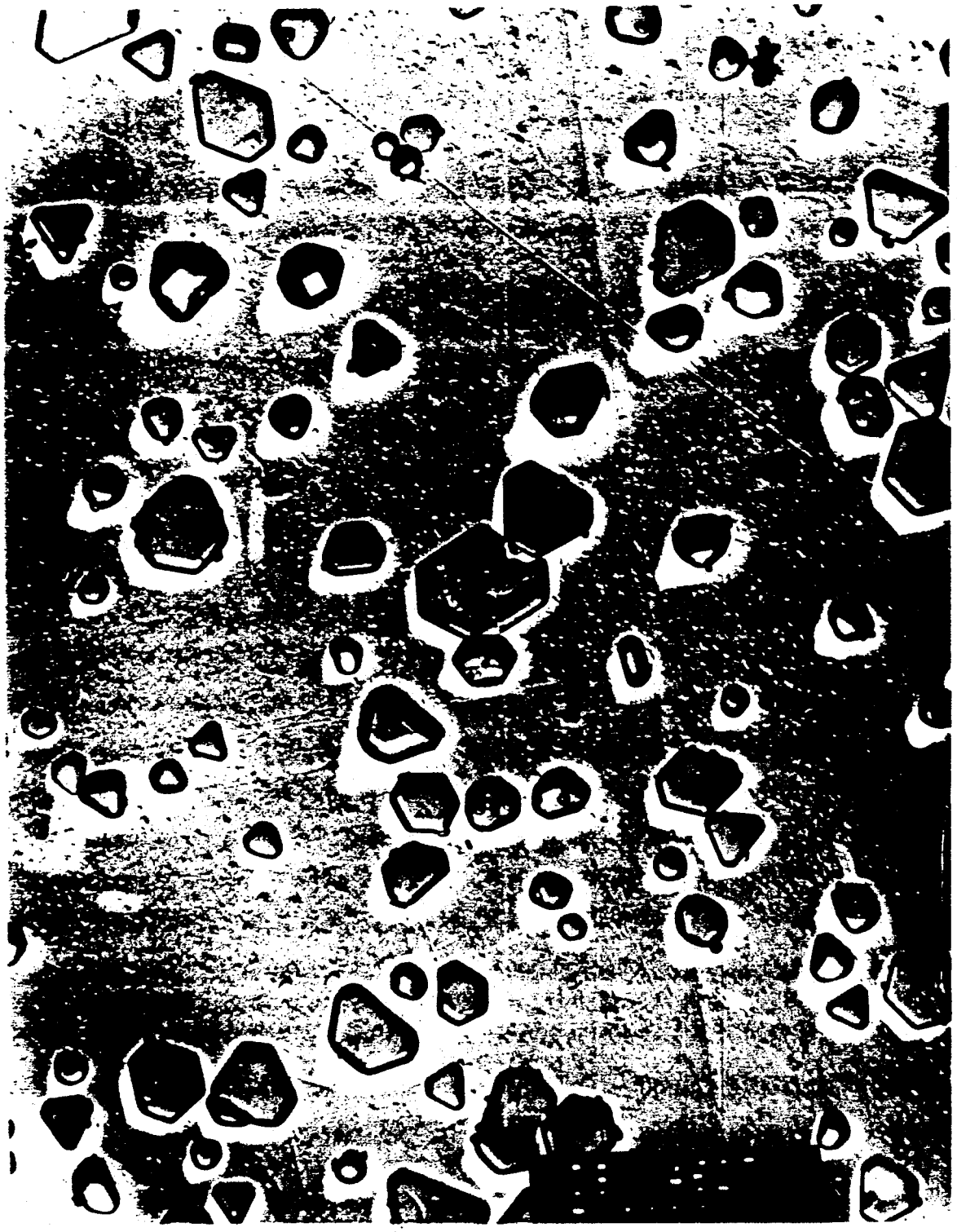
FIG. 2 is a electron micrograph (magnification 12800×) of silver halide crystals produced after step (d) of Example 1.

The crystals of the final emulsion are shown in FIG. 2. They had a mean size of 0.88 microns (based on a measurement of volume). The overall proportion of silver iodide was 10 mol % of the total silver halide and the final emulsion contained 8.32 moles of silver halide.

Sensitization (step e)

The emulsion was desalinated and redispersed with a solution of limed ossein gelatin. It was adjusted at 40° C. to pH 6.0 and pAg 8.2. It was then digested at 52° C. for a range of times (from 60 to 150 minutes) and with a range of sensitizer quantities (12 to 30 mg/mole of sodium thiosulfate pentahydrate and 1.78–4.45 mg/mole Ag of sodium tetrachloroaurate dihydrate sensitizer). Optimum photographic sensitivity was found when 17.8 mg of sodium thiosulfate pentahydrate and 2.67 mg sodium tetrachloroaurate dihydrate per mole of silver halide was added. The emulsion was stabilized using 0.41 g of 4-hydroxy 6 methyl 1,3,3a tetraazaindene per mole of silver halide. The optimally sensitized emulsion was then coated on a triacetate base at 50 mg Ag/$dm^2$.

This is Emulsion B.

COMPARATIVE EXAMPLE

Preparation of tabular twinned octahedral silver iodobromide emulsion (Emulsion A)

Emulsion A was produced following methods described in BP 1596602, Example 1 and was similar in final crystal size, iodide mol %, and recrystallization conditions to the emulsions (B,C) of the present invention.

Preparation of a bipyramidal monosized silver iodide emulsion (step a)

2750 g of 9.0% w/w aqueous solution of inert gelatin was stirred at 40° C. at 1000 rpm in a stainless steel vessel. Tri-n-butyl orthophosphate was added as an antifoam. Sufficient of a 4.7 m aqueous solution of potassium iodide was added to give pI2.3. Aqueous 4.7 m solutions of silver nitrate and potassium iodide were jetted into the stirred gelatin at a rate (for the silver nitrate solution) increasing from approximately 20 $cm^3$/min to 65 $cm^3$/min until a total of 1600 $cm^3$ of silver nitrate solution had been added over a period of approximately 41 minutes.

Then, further volumes of these solutions were added at a rate (for the silver nitrate solution) increasing from 100 $cm^3$/min to 175 $cm^3$/min until a total of 10840 $cm^3$ of silver nitrate solution had been added. The pI of the emulsion was maintained throughout at a value of 2.3 (+0.05) by adjusting the rate of flow of the potassium iodide solution. The temperature was kept at 40° C.

Then 13065 ml of 4.7 M of silver nitrate and 4.7 M potassium iodide were added at 390 ml/minute maintaining the pI at 2.3±0.1. During this period 4875 g of 32% w/w aqueous inert gelatin was also added.

Finally 26130 mol of 4.7 M silver nitrate and 4.7 M potassium bromide was added maintaining the pI at 2.3±0.1. The rate of addition was increased from 488 to 585 ml/m.

During this period 6611g of 32% w/w aqueous inert gelatin was added.

Figure 3:
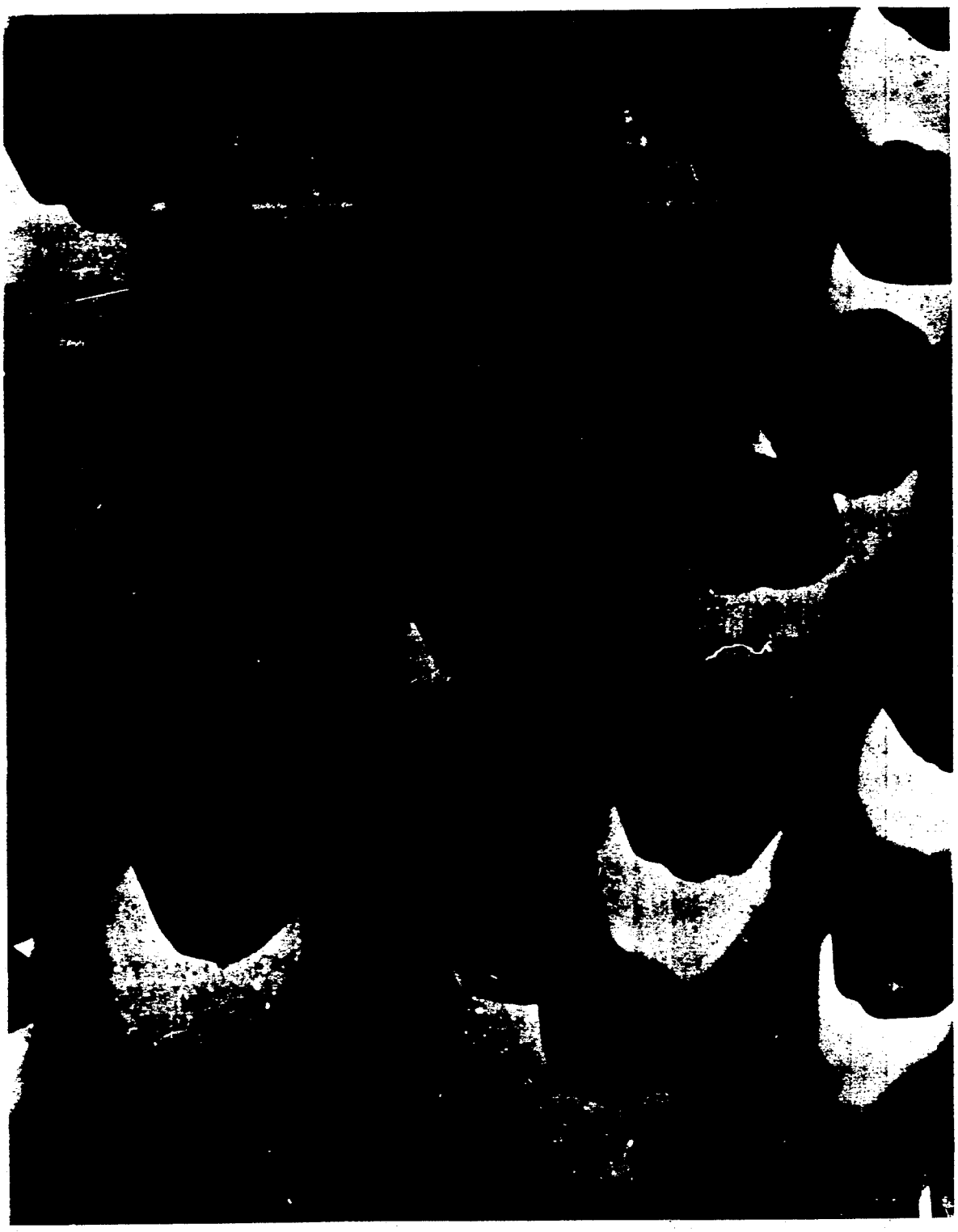
FIG. 3 is a electron micrograph (magnification 12800×) of silver iodide crystals produced as described in the Comparative Example below.

The yield of emulsion obtained after all these additions was 243 moles of silver. The median diameter of the silver iodide crystals was 0.61 microns (based on volume) and over 95% were of the truncated bipyramidal habit. They comprised 100% silver iodide. They were of hexagonal habit and had an aspect ratio of 1:1. They are shown in FIG. 3.

Recrystallization (step b)

Approximately 6120 g of the above silver iodide emulsion which contained 24 moles of silver iodide was stirred at 65° C. at 1000 rpm in a stainless steel vessel. Tri-n-butyl orthophosphate was added as an antifoam.

Aqueous solutions of silver nitrate and sodium bromide were jetted into the stirred silver iodide emulsion at rates (for the silver nitrate) increasing from 0.024 mol/min to 0.048 mol/min until 2.4 mol of silver nitrate had been added over a period of 75 minutes. 1488 g of 35% w/w aqueous inert gelatin was added, and further volumes of silver nitrate and sodium bromide solutions were jetted in at a starting rate of 0.153 mol/min (for the silver nitrate) until 26.80 moles of silver nitrate had been added.

Further volumes of silver nitrate and sodium bromide solutions were jetted in at a starting rate (for the silver nitrate) of 0.235 mol/min until 26.80 moles of silver nitrate had been added. 1552 g of 38% w/w aqueous gelatin was added.

Figure 4:
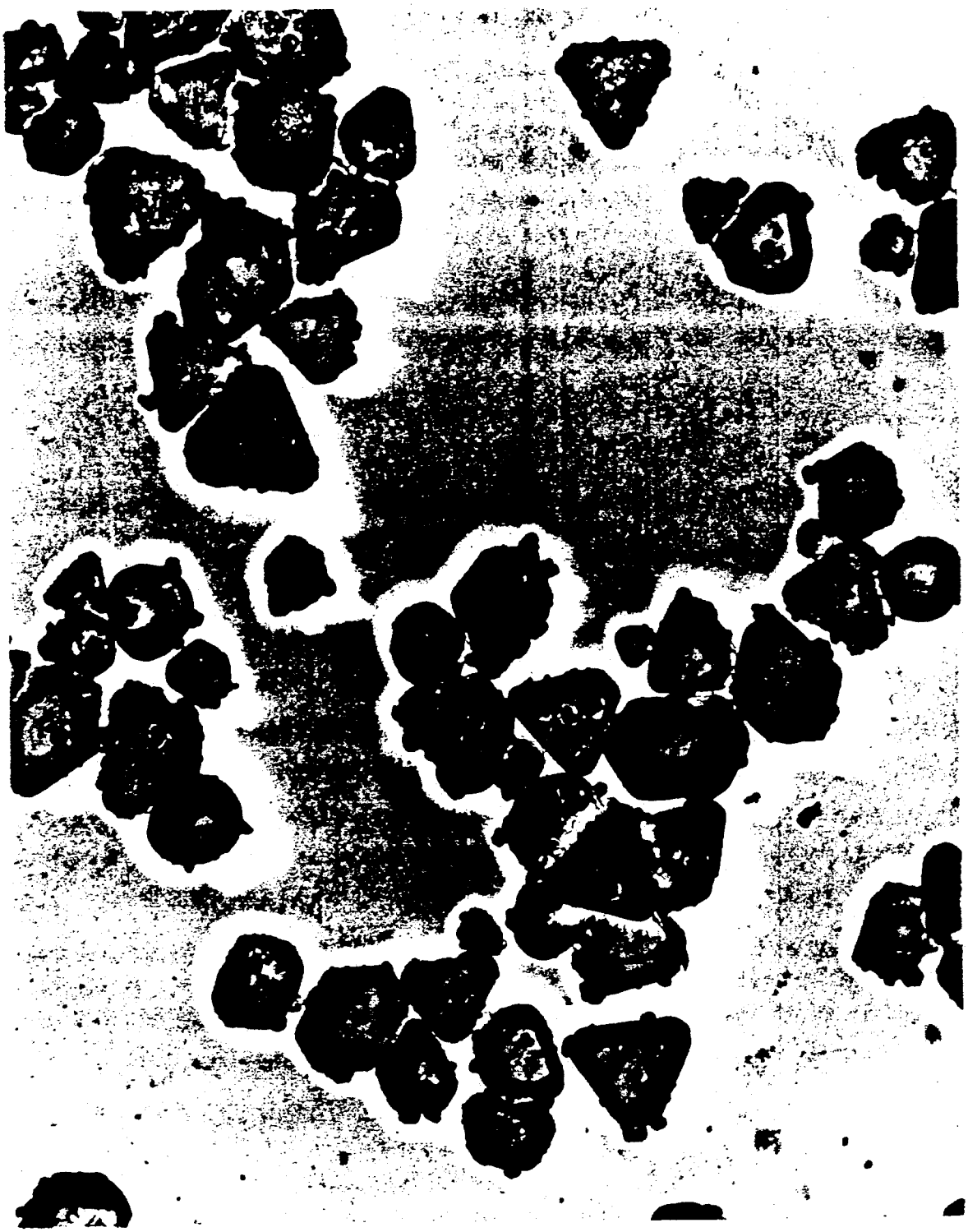
FIG. 4 is a electron micrograph (magnification 32000×) of silver halide crystals produced as described in the Comparative Example below after recrystallization (step b).

The pAg of the emulsion was maintained throughout at 7.65 (±0.1) by adjusting the flow rate of the bromide solution and the temperature was maintained at 65° C. The crystals of this emulsion are shown in FIG. 4. The yield was 80 moles of silver halide with an overall content of 30 mol % silver iodide. The diameter mean of the silver iodobromide crystals was 0.8 microns.

Further growth (step d)

Approximately 14400 g of the above mixed silver iodobromide emulsion which contained 20 moles of silver halide was stirred at 65° C. at 1000 rpm in a stainless steel vessel. Tri-n-butyl orthophosphate was added as an antifoam. Aqueous solutions of silver nitrate and sodium bromide were jetted into the stirred silver iodobromide emulsion at rates (for the silver nitrate) increasing from 0.0973 mol/min until a total of 13.33 moles of silver nitrate had been added over a period of 83 minutes at a pAg of 9.2. 747 g of 36% w/w aqueous inert gelatin was added.

Further volumes of the silver nitrate and sodium bromide solutions were jetted in at rates (for the silver nitrate) increasing from 0.686 mol/min until 26.67 moles of silver nitrate had been added over a period of 61 minutes. The pAg of the emulsion was maintained throughout at 9.2 (±0.1) by adjusting the flow rate of the bromide solution and the temperature was maintained at 65° C.

The crystals of the final emulsion are shown in FIG. 4. They had a mean size of 0.9 microns (based on a measurement of volume). The overall proportion of silver iodide was 10% of the total silver halide and the yield was 60.0 moles of silver halide.

This emulsion was chemically sensitized as the emulsion B except that optimum photographic sensitivity was found when 8.88 mg of sodium thiosulfate pentahydrate and 1.33 mg of sodium tetrachloroaurate per mole of silver halide was added.

The optimally sensitized emulsion was then coated on a triacetate base at 50 mg Ag/dm$^2$.

This emulsion is referred to as Emulsion A.

Coated samples of Emulsion A and B were photographically exposed through a continuous wedge to white light for 0.02 seconds and developed for 8 minutes in a developer of the following formula at 20° C. (developer I).

| | |
|---|---|
| Metol | 2 g |
| Hydroquinone | 5 g |
| Sodium sulphite | 100 g |
| Borax* | 3 g |
| Sodium tripolyphosphate | 3.5 g |
| Water to | 1 liter |

(*sodium tetraborate.10 $H_2O$)

The results obtained were as follows:

| Emulsion | Silver Coating Weight (mg/dm$^2$) | Speed | Median Crystal volume (um$^3$) |
|---|---|---|---|
| A | 50 | 4.99 | 0.38 |
| B | 50 | 5.17 | 0.36 |

Here, speed is photographic foot speed on a relative log exposure scale at a density of 0.1 above fog.

The above photographic results show the emulsion of this invention (emulsion B) to have higher sensitivity as the ratio of speed to crystal volume is higher at a matched coating weight.

EXAMPLE 2

Preparation of Emulsion C, an emulsion according to the present invention

The emulsion was precipitated in a similar way to emulsion B except that during step b the first 0.6 mol of silver nitrate was jetted in at rates increasing from 0.048 to 0.096 mol/min.

Chemical sensitization was carried out according to the conditions given for emulsion B except that 13.3 mg of sodium thiosulfate pentahydrate and 2.0 mg of sodium tetrachloroaurate dihydrate per mole of silver halide was added.

Spectral Sensitization

After chemical sensitization emulsion C was spectrally sensitized with a panchromatic sensitizer A of the formula

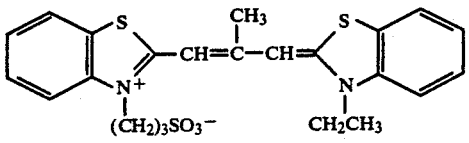

which was added in ethanolic solution in a range of quantities.

Optimum photographic sensitivity to white light exposure was attained at a level of 0.2 g of spectral sensitizer A per mole of silver halide in the emulsion.

Emulsion A was used as a comparative example, and was also chemically spectrally sensitized. Optimum photographic sensitivity to white light exposure was attained at a lower level than emulsion C, 0.13 g per mole of silver halide.

Photographic results

Emulsions A and C were coated on triacetate base at 45 mg Ag/dm$^2$.

Coated samples of these emulsions were photographically exposed to white light through a continuous wedge for 0.02 seconds and developed for 10 minutes in a developer of the following formula at 20° C. (developer II).

| | |
|---|---|
| Metol | 2 gm |
| Hydroquinone | 8 gm |
| Sodium Sulphite, anhydrous | 90 gm |
| Sodium Carbonate, anhydrous | 45 gm |
| Potassium Bromide | 5 gm |
| Water to make | 1 liter |

Samples were also exposed as above, except that red, green and blue filters were used.

| | EXPOSURE | | | |
|---|---|---|---|---|
| Emulsion | White | Red | Green | Blue |
| A (comparative) | 5.40 | 4.75 | 4.08 | 4.62 |
| C (invention) | 5.56 | 4.87 | 4.55 | 4.73 |

The photographic results show that the emulsion of the invention shows increased sensitivity to white light, as well as increased sensitivity in the minus blue regions of the spectrum.

EXAMPLE 3

Emulsions A (comparative) and C (invention) were again chemically sensitized as in Example 2. Panchromatic sensitization also carried out at levels of 0.13 and 0.20 g of spectral sensitizer (A) per mole of silver halide.

Photographic exposure was made as in Example 2. Developer II was used at 20° C. and 10 minutes development.

PHOTOGRAPHIC RESULTS

1. White light exposure

| | Speed at 0.13 g/mole silver halide of spectral sensitizer A | Speed at 0.2 g/mole of spectral sensitizer A |
|---|---|---|
| Emulsion A (comparative) | 5.25 | 5.25 |
| Emulsion C (invention) | 5.46 | 5.52 |

This result shows that emulsion C of the invention is able to use a higher level of spectral sensitizer A for optimum white light sensitivity.

2. Exposure through red, green and blue filters

| | Level of spectral sensitizer A (g/mole) | Speed | | |
|---|---|---|---|---|
| | | Red | Green | Blue |
| Emulsion C | 0.13 | 4.75 | 4.52 | 4.76 |
| (invention) | 0.2 | 4.89 | 4.63 | 4.74 |
| Emulsion A | 0.13 | 4.61 | 4.42 | 4.51 |
| (comparative) | 0.2 | 4.66 | 4.41 | 4.48 |

This result shows that a higher level of spectral sensitizer A (0.2 g/mole Ag) is beneficial for emulsion C from the point of view of minus blue speed.

We claim:

1. A method of preparing a silver halide emulsion wherein the silver halide crystals are of the twinned type which comprises the steps of (a) providing as seed crystals forming in a colloid dispersing medium tabular silver halide crystals containing at least about 90 mole % iodide, at least 90% of said seed crystals being of the hexagonal lattice structure with a mean thickness of less than 0.6 microns and a mean aspect ratio of greater than 2:1;

(b) mixing in the dispersing medium containing the said seed crystals an aqueous solution of a silver salt and an aqueous solution of at least one salt selected from the group consisting of chloride and bromide salts of alkali metals and ammonium and mixtures thereof and continuing the addition of said aqueous solutions until dissolution of said seed crystals is substantially complete thereby forming twinned silver halide crystals containing iodide and the halide being added and having a mean aspect ratio of greater than 1:1.

2. The method of claim 1 further comprising:

(c) adding a silver halide solvent to the dispersing medium thereby causing the twinned crystals to grow by Ostwald ripening.

3. The method of claims 1 or 2 further comprising:

(d) causing the twinned crystals to increase in size by adding to the colloidal dispersion a further silver salt solution and a further halide of an alkali metal or ammonium or mixtures thereof.

4. The method of claim 3 further comprising:

(e) removing the water-soluble salts formed and chemically and spectrally sensitizing the emulsion.

5. The method of claim 1 where in step (a) the pI is about 3.

6. The method of claim 1 where in step (a) the temperature is maintained between 70° to 95° C.

7. A method according to claim 5 wherein the temperature is maintained at about 90° C.

8. A method according to claim 1 wherein sufficient alkali metal iodide is added to the dispersing medium to provide a pI of about 3 before the water-soluble silver salt and alkali metal or ammonium iodide are added to the dispersing medium.

9. A method according to claim 1 where in step (b) the temperature of the aqueous medium is from 35° to 70° C. and the pAg is maintained between 6 to 10.

10. A method according to claim 1 wherein the mole % iodide content of the twinned silver halide crystals after step (b) is between 30 and 40%.

11. A method according to claim 3 wherein the mole % iodide content of the twinned silver halide crystals after step (d) is between 0.5 and 25%.

12. A method according to claim 10 further comprising (d) causing the twinned crystals to increase in size by adding to the colloidal dispersion a further silver salt solution and a further halide of an alkali metal or ammonium or mixtures thereof wherein the mole % iodide content of the twinned silver halide crystals after step (d) is from 5 to 20%.

13. A method according to claim 3 where in both step (b) and in step (d) the soluble silver salt and the alkali metal or ammonium halide are added to dispersion medium by a double jetting method.

14. A method according claim 1 where in step (b) the addition rates of the silver and the halide solutions are predetermined.

15. A method according to claim 1 wherein step (b) is carried out in the presence of a polyalkene wetting agent.

16. A photographic silver halide emulsion which has been prepared by the method of any one of claims 1, 2, 3 and 4.

17. Photographic material which comprises in at least one photosensitive layer at least one emulsion as claimed in claim 16.

18. The method of claim 1 said step (a) comprising forming said crystals in said dispersing medium.

* * * * *